US006219854B1

(12) United States Patent
Milliman et al.

(10) Patent No.: US 6,219,854 B1
(45) Date of Patent: Apr. 24, 2001

(54) TOILET SEAT LIFTING APPARATUS

(76) Inventors: John R. Milliman; Chad L. Milliman, both of 16908 E. 300th Ave., West Liberty, IL (US) 62475

( * ) Notice: Subject to any disclaimer, the term of this patent is extended or adjusted under 35 U.S.C. 154(b) by 0 days.

(21) Appl. No.: 09/502,298

(22) Filed: Feb. 11, 2000

(51) Int. Cl.[7] ..... A47K 13/10
(52) U.S. Cl. ..... 4/246.1; 4/246.3; 4/246.4
(58) Field of Search ..... 4/246.1, 246.2, 4/246.3, 246.4, 246.5, 248; 220/262, 263, 264; 16/221, 223, 372, 385

(56) References Cited

U.S. PATENT DOCUMENTS 3,504,385 * 4/1970 Fields ..... 4/246.1
4,862,525 * 9/1989 Cheng ..... 4/246.3
5,237,708 * 8/1993 Zamoyski ..... 4/246.3
5,788,874 * 8/1998 Tucker, Jr. ..... 16/221
5,829,068 * 11/1998 Smith ..... 4/246.3
5,857,223 * 1/1999 Ferdinand ..... 4/246.1
6,039,200 * 3/2000 Armor ..... 220/263

FOREIGN PATENT DOCUMENTS

262335 * 7/1913 (DE) ..... 4/246.4

* cited by examiner

*Primary Examiner*—Gregory L. Huson
*Assistant Examiner*—Khoa Huynh

(57) ABSTRACT

A toilet seat lifting apparatus for lifting a toilet seat with a user's foot. The toilet seat lifting apparatus includes a toilet and a lifting assembly. The toilet has a bowl. A toilet seat is hingedly coupled to the top edge of the top section of the bowl. A lifting assembly for lifting the toilet seat has a base portion. The base portion has a top surface and a bottom surface for mounting on a floor surface adjacent to the toilet. A platform is hingedly connecting the platform to the base portion. A first rod is elongate, having a first end, a second end and a middle portion. The middle portion is coupled to the platform. A second rod is elongate and has a first end and a second end. The first end of the second rod is hingedly coupled to the second end of the first rod. The second end of the second rod is coupled to the toilet seat.

12 Claims, 2 Drawing Sheets

FIG 3
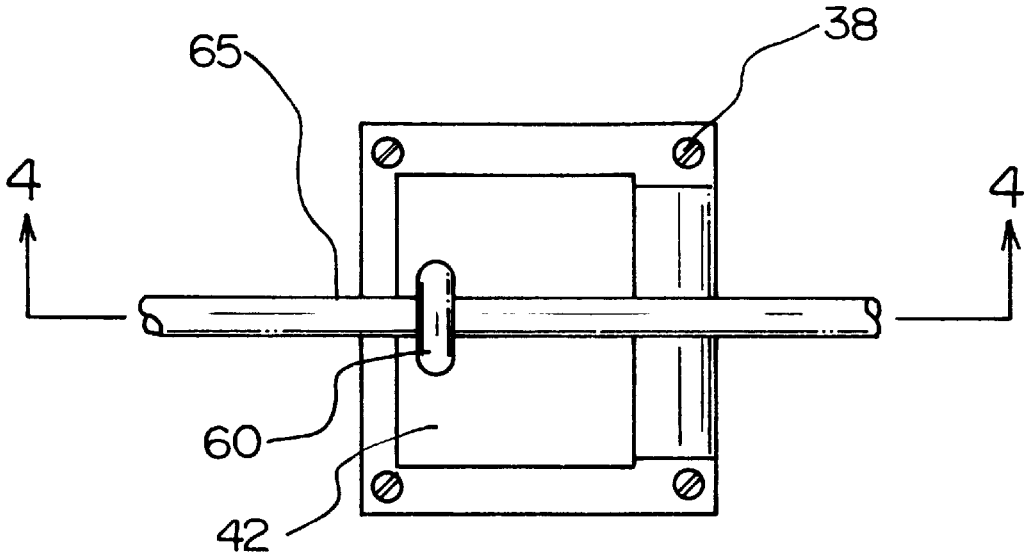
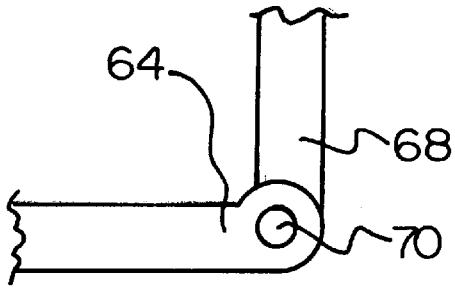
FIG. 5
FIG 4
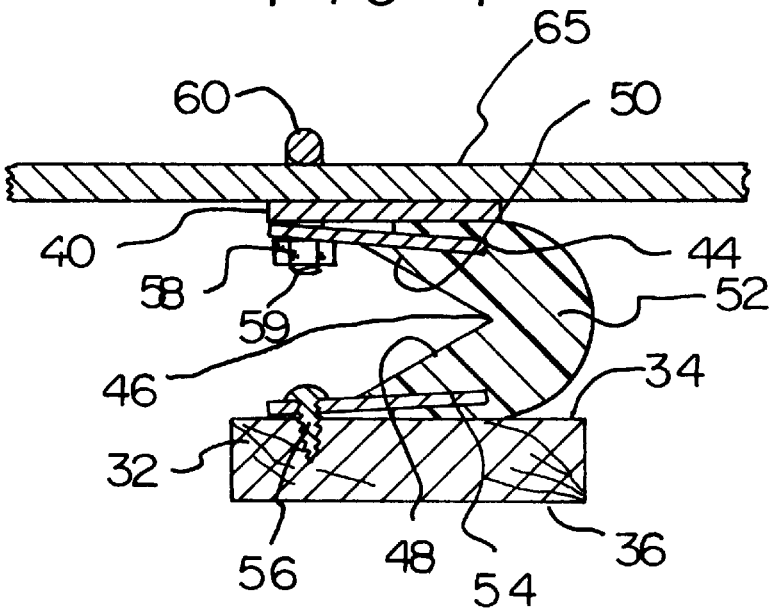

TOILET SEAT LIFTING APPARATUS

BACKGROUND OF THE INVENTION

1. Field of the Invention

The present invention relates to lifting devices and more particularly pertains to a new toilet seat lifting apparatus for lifting a toilet seat with a user's foot.

2. Description of the Prior Art

The use of lifting devices is known in the prior art. More specifically, lifting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,323,496; U.S. Pat. No. 5,404,595; U.S. Pat. No. 2,954,565; U.S. Pat. No. 621,790; U.S. Pat. No. 2,155,548; and U.S. Des. Pat. No. 341,416.

While these devices fulfill their respective, particular objectives and requirements, the aforementioned patents do not disclose a new toilet seat lifting apparatus. The inventive device includes a toilet and a lifting means. The toilet has a bowl. A toilet seat is hingedly coupled to the top edge of the top section of the bowl. A lifting means for lifting the toilet seat has a base portion. The base portion has a top surface and a bottom surface for mounting on a floor surface adjacent to the toilet. A platform is hingedly connecting the platform to the base portion. A first rod is elongate, having a first end, a second end and a middle portion. The middle portion is coupled to the platform. A second rod is elongate and has a first end and a second end. The first end of the second rod is hingedly coupled to the second end of the first rod. The second end of the second rod is coupled to the toilet seat.

In these respects, the toilet seat lifting apparatus according to the present invention substantially departs from the conventional concepts and designs of the prior art, and in so doing provides an apparatus primarily developed for the purpose of lifting a toilet seat with a user's foot.

SUMMARY OF THE INVENTION

In view of the foregoing disadvantages inherent in the known types of lifting devices now present in the prior art, the present invention provides a new toilet seat lifting apparatus construction wherein the same can be utilized for lifting a toilet seat with a user's foot.

The general purpose of the present invention, which will be described subsequently in greater detail, is to provide a new toilet seat lifting apparatus apparatus and method which has many of the advantages of the lifting devices mentioned heretofore and many novel features that result in a new toilet seat lifting apparatus which is not anticipated, rendered obvious, suggested, or even implied by any of the prior art lifting devices, either alone or in any combination thereof.

To attain this, the present invention generally comprises a toilet and a lifting means. The toilet has a bowl. A toilet seat is hingedly coupled to the top edge of the top section of the bowl. A lifting means for lifting the toilet seat has a base portion. The base portion has a top surface and a bottom surface for mounting on a floor surface adjacent to the toilet. A platform is hingedly connecting the platform to the base portion. A first rod is elongate, having a first end, a second end and a middle portion. The middle portion is coupled to the platform. A second rod is elongate and has a first end and a second end. The first end of the second rod is hingedly coupled to the second end of the first rod. The second end of the second rod is coupled to the toilet seat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet seat lifting apparatus apparatus and method which has many of the advantages of the lifting devices mentioned heretofore and many novel features that result in a new toilet seat lifting apparatus which is not anticipated, rendered obvious, suggested, or even implied by any of the prior art lifting devices, either alone or in any combination thereof.

It is another object of the present invention to provide a new toilet seat lifting apparatus which may be easily and efficiently manufactured and marketed.

It is a further object of the present invention to provide a new toilet seat lifting apparatus which is of a durable and reliable construction.

An even further object of the present invention is to provide a new toilet seat lifting apparatus which is susceptible of a low cost of manufacture with regard to both materials and labor, and which accordingly is then susceptible of low prices of sale to the consuming public, thereby making such toilet seat lifting apparatus economically available to the buying public.

Still yet another object of the present invention is to provide a new toilet seat lifting apparatus which provides in the apparatuses and methods of the prior art some of the advantages thereof, while simultaneously overcoming some of the disadvantages normally associated therewith.

Still another object of the present invention is to provide a new toilet seat lifting apparatus for lifting a toilet seat with a user's foot.

Yet another object of the present invention is to provide a new toilet seat lifting apparatus which includes a toilet and a lifting means. The toilet has a bowl. A toilet seat is hingedly coupled to the top edge of the top section of the bowl. A lifting means for lifting the toilet seat has a base portion. The base portion has a top surface and a bottom surface for mounting on a floor surface adjacent to the toilet. A platform is hingedly connecting the platform to the base portion. A first rod is elongate, having a first end, a second end and a middle portion. The middle portion is coupled to the platform. A second rod is elongate and has a first end and a second end. The first end of the second rod is hingedly coupled to the second end of the first rod. The second end of the second rod is coupled to the toilet seat.

Still yet another object of the present invention is to provide a new toilet seat lifting apparatus that has an adjustable stop on the second rod to allow for variance in toilet height.

Even still another object of the present invention is to provide a new toilet seat lifting apparatus that extends beyond the toilet so that the first rod may be depressed with a foot while the toilet is being used.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic plan view of the first rod being coupled to the plate of the present invention.

FIG. 4 is a schematic cross-sectional view of the hinge of the present invention.

FIG. 5 is a schematic side view of the connection of the first and second rods of the hinge of the present invention.

DESCRIPTION OF THE PREFERRED EMBODIMENT

Figure 1:
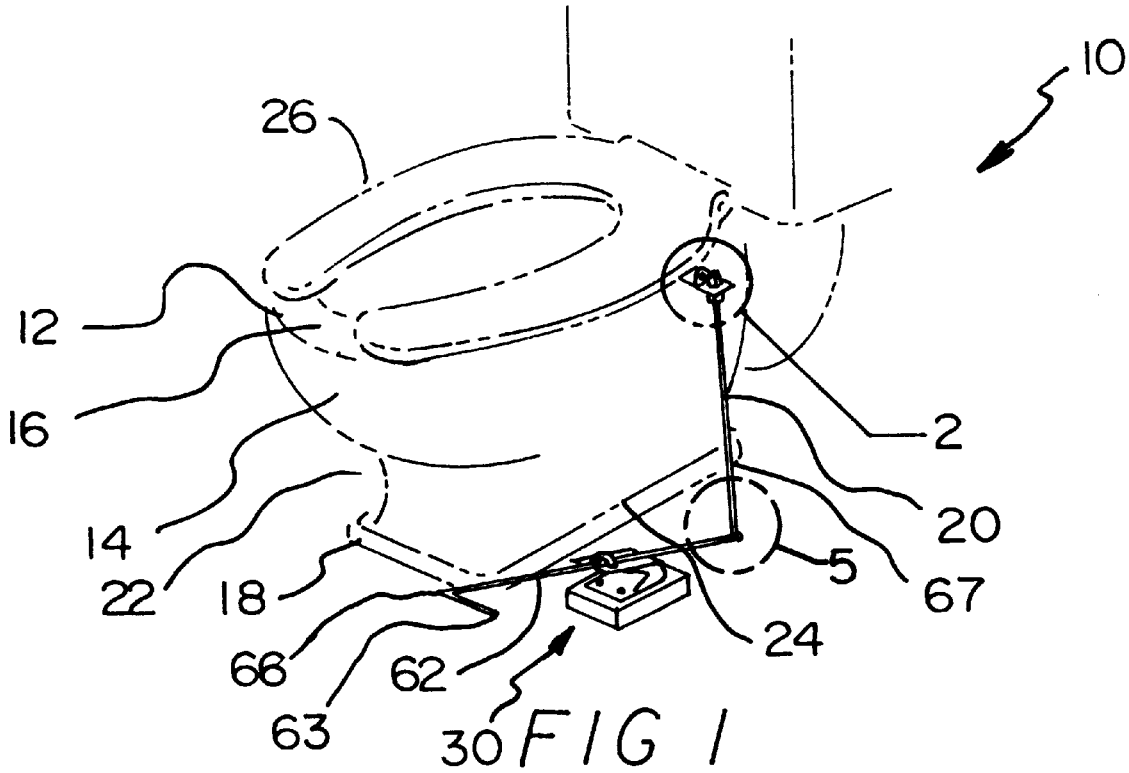
FIG. 1 is a schematic perspective view of a new toilet seat lifting apparatus according to the present invention.
Figure 2:
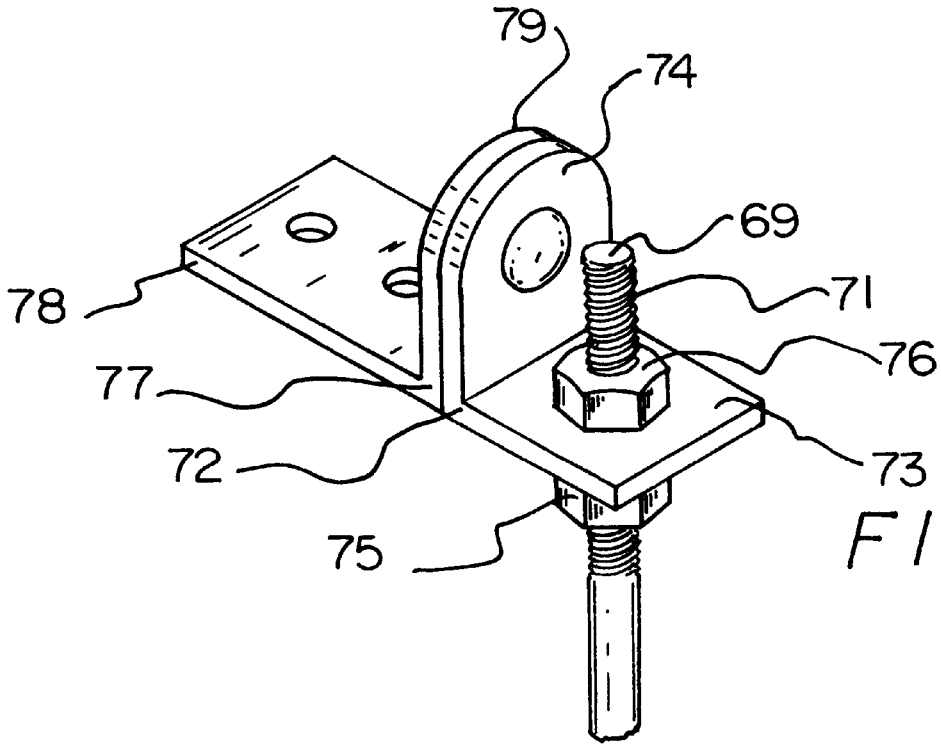
FIG. 2 is a schematic perspective view of the first and second brackets of the present invention.

With reference now to the drawings, and in particular to FIGS. 1 through 5 thereof, a new toilet seat lifting apparatus embodying the principles and concepts of the present invention and generally designated by the reference numeral 10 will be described.

As best illustrated in FIGS. 1 through 5, the toilet seat lifting apparatus 10 generally comprises a toilet 12 and a lifting device 30. The toilet 12 has a bowl 14. The bowl 14 portion has a top section 16 and a base section 18. The bowl 14 has a distal end 20, a proximal 22 and a middle portion 24.

A toilet seat 26 is hingedly coupled to a top edge of the top section 16 of the bowl 14. The toilet seat 26 is hingedly coupled to the distal end 20 of the bowl.

A lifting means 30 lifts the toilet seat 26. The lifting means 30 first comprises a base portion 32 having a top surface 34 and a bottom surface 36 for mounting on a floor surface adjacent to the toilet 12. The base portion 32 is generally planar and has a generally rectangular shape. The base portion 32 is located generally adjacent to the middle portion 24 of the bowl 14.

A plurality of securing means 38 secures the base portion 32 to a floor. The plurality of securing means 38 comprises four securing fasteners. Each of the securing fasteners extends through the base portion 32 and into the floor. Each of the securing means 38 is located generally adjacent to a corner of the base portion 32 and each of the securing means comprising a screw.

A platform 40 is generally planar having a top surface 42 and a bottom surface 44. The platform 40 has a generally rectangular shape.

A hinge 46 hingedly connects the platform 40 to the base 32 portion. The hinge 46 is generally U-shaped having two legs 48, 50 and middle portion 52. The two legs define a V-shaped space. A pair of plates 54 reinforce the hinge and are embedded in the hinge 46. Each of the plates 54 is in one of the legs 48, 50. A first of the legs 48 is fastened to the top surface 34 of the base portion 32 by a fastening means 56. The fastening means 56 is a screw. The middle portion 52 of the hinge 46 is directed toward the distal end 20 of the bowl 14.

A coupling means 58 couples the platform 40 to a second leg 50 of the hinge 46. The coupling means 58 has a first end 59 and a second end 60. The first end 59 is threaded. The first end 59 is inserted through the platform 40 and through the second leg 50 such that the bottom surface 44 of the platform 40 is abutted against the second leg 50 of the hinge 46. The second end 60 of the coupling means 58 forms an annular member.

A first elongate rod 62 has a first end 63, a second end 64 and a middle portion 65. The rod 62 extends through the annular member 60. The first rod 62 has a bend 66 therein, which is generally adjacent to the first end 63. The bend 66 is substantially equal to ninety degrees such that the first end 63 extends away from the bowl 14. The second end 64 of the first rod 62 is generally between the distal end 20 of the bowl and the base portion 32. The proximal end 22 of the base 18 of the toilet 12 is between the bend 66 in the first rod 62 and base portion 32.

A second elongate rod 67 has a first end 68 and a second end 69. The first end 68 of the second rod 67 and the second end 64 of the first rod 62 each has a bore therethrough. A pin 70 extends through the bores such that the first 62 and second 67 rods are pivotally coupled together. The second rod 67 has an outer surface having threads 71 thereon. The threads 71 are generally adjacent to the second end 69 of the second rod 67.

A first bracket 72 is generally L-shaped and has a foot portion 73 and an arm portion 74. The foot portion 73 has a bore therein. The second end 69 of the second rod 67 is inserted through the bore in the foot portion 73 of the first bracket 72 such that the arm portion 74 of the first bracket 72 is directed upwardly away from the second rod 67. The arm portion 74 has a bore therein.

A first 75 and second 76 stop hold the first bracket 72 with respect to the second rod 67. The first stop 75 is located on the second rod 67 between the foot 73 of the first bracket 72 and the first end 68 of the second rod 67. The second stop 76 is located on the second rod 67 between the foot 73 and the second end 69 of the second bracket 67. Each of the stops is a nut.

A second bracket 77 has a shape generally identical to the first bracket. The foot 78 of the second bracket 77 has two bores therein, and the arm 79 of the second bracket 77 has a bore therein. The arm 79 of the second bracket 77 is rotatably coupled to the arm 74 of the first bracket 72. The foot 78 of the second bracket 77 is removably coupled to a bottom surface of the toilet seat 26. The second bracket 77 is generally adjacent to the distal end 20 of the bowl 14.

In use, the foot 78 of the second bracket 77 is coupled to the bottom surface of the distal end of the toilet seat 26. The first end of the first rod 63 is placed beyond the proximal end 22 of the toilet 12 so that the user may step on the first end of the first rod 62 while in the process of using the toilet. When the user is finished, the rod is released and the toilet seat returns to its resting position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toilet seat lifting apparatus, said apparatus comprising:

a toilet, said toilet having a bowl;

a toilet seat, said toilet seat being hingedly coupled to a top edge of a top section of said bowl;

a lifting means for lifting said toilet seat, said lifting means comprising:

a base portion, said base portion having a top surface and a bottom surface for mounting on a floor surface adjacent to said toilet;

a platform;

a hinge for hingedly connecting said platform to said base portion;

a first rod, said first rod being elongate, said first rod having a first end, a second end and a middle portion, said middle portion being coupled to said platform;

a second rod, said second rod being elongate, said second rod having a first end and a second end, said first end of said second rod being hingedly coupled to said second end of said first rod, said second end of said second rod being coupled to said toilet seat;

said bowl having a distal end, a proximal and a middle portion;

said toilet seat being hingedly coupled to said distal end of said bowl;

said base portion being generally planar, said base portion having a generally rectangular shape, said base portion being located generally adjacent to said middle portion of said bowl;

a plurality of securing means for securing said base portion to a floor, said plurality of securing means comprising four securing fasteners, each of said securing fasteners extending through said base portion and into said floor;

said platform being generally planar, said platform having a top surface and a bottom surface, said platform having a generally rectangular shape;

said hinge being generally U-shaped, said hinge having two legs and middle portion, said two legs defining a V-shaped space, a pair of plates for reinforcing said hinge are embedded in said hinge, each of said plates being in one of said legs, a first of said legs being fastened to said top surface of said base portion by a fastening means, said fastening means being a screw, wherein said middle portion of said hinge is directed toward said distal end of said bowl; and a coupling means for coupling said platform to a second leg of said hinge, said coupling means having a first end and a second end, said first end being threaded, said first end being inserted through said platform and through said second leg such that said bottom surface of said platform is abutted against said second leg of said hinge, said second end of said coupling mean forming an annular member.

2. The toilet seat lifting apparatus as in claim 1, wherein said lifting means comprises:

said first rod extending through said annular member, said first rod having a bend therein, said bend being generally adjacent to said first end, said bend being substantially equal to ninety degrees such that said first end extends away from said bowl, said second end of said first rod being generally between said distal end of said bowl and said base portion.

3. The toilet seat lifting apparatus as in claim 2, wherein said lifting means comprises:

said first end of said second rod and said second end of said first rod each having a bore therethrough, a pin extending through said bores such that said first and second rods are pivotally coupled together, said second rod having an outer surface having threads thereon, said threads being generally adjacent to said second end of said second rod.

4. The toilet seat lifting apparatus as in claim 3, further comprising:

a first bracket for coupling said second rod to said toiler seat, said first bracket being generally L-shaped having a foot portion and an arm portion, said foot portion having a bore therein, said second end of said second rod being inserted through said bore in said foot portion of said first bracket such that said arm portion of said first bracket is directed upwardly away from said second rod, said arm portion having a bore therein;

a first and second stop for holding said first bracket with respect to said second rod, said first stop being located on said second rod between said foot of said first bracket and said first end of said second rod, said second stop being located on said second rod between said foot and said second end of said second bracket, each of said stops being a nut; and a second bracket, said second bracket having a shape generally identical to said first bracket, said foot of said second bracket having two bores therein, said arm of said second bracket having a bore therein, said arm of said second bracket being rotatably coupled to said arm of said first bracket, said foot of said second bracket being removably coupled to a bottom surface of the toilet seat, said second bracket being generally adjacent to said distal end of said bowl.

5. A toilet seat lifting apparatus, said apparatus comprising:

a toilet, said toilet having a bowl, said bowl portion having a top section and a base section, said bowl having a distal end, a proximal and a middle portion;

a toilet seat, said toilet seat being hingedly coupled to said top edge of said top section of said bowl, said toilet seat being hingedly coupled to said distal end of said bowl;

a lifting means for lifting said toilet seat, said lifting means comprising:

a base portion, said base portion having a top surface and a bottom surface for mounting on a floor surface adjacent to said toilet, said base portion being generally planar, said base portion having a generally rectangular shape, said base portion being located generally adjacent to said middle portion of said bowl;

a plurality of securing means for securing said base portion to a floor, said plurality of securing means comprising four securing fasteners, each of said securing fasteners extending through said base portion and into said floor, each of said securing means being located generally adjacent to a corner of said base portion, each of said securing means comprising a screw;

a platform, said platform being generally planar, said platform having a top surface and a bottom surface, said platform having a generally rectangular shape;

a hinge for hingedly connecting said platform to said base portion, said hinge being generally U-shaped, said hinge having two legs and middle portion, said two legs defining a V-shaped space, a pair of plates for reinforcing said hinge are embedded in said hinge, each of said plates being in one of said legs, a first of said legs being fastened to said top surface of said base portion by a fastening means, said fastening means being a screw, wherein said middle portion of said hinge is directed toward said distal end of said bowl;

a coupling means for coupling said platform to a second leg of said hinge, said coupling means having a first end and a second end, said first end being threaded, said first end being inserted through said platform and through said second leg such that said bottom surface of said platform is abutted against said second leg of said hinge, said second end of said coupling mean forming an annular member;

a first rod, said first rod being elongate, said first rod having a first end, a second end and a middle portion, said first rod extending through said annular member, said first rod having a bend therein, said bend being generally adjacent to said first end, said bend being substantially equal to ninety degrees such that said first end extends away from said bowl, said second end of said first rod being generally between said distal end of said bowl and said base portion, said proximal end of said base of said toilet being between said bend in said first rod and base portion;

a second rod, said second rod being elongate, said second rod having a first end and a second end, said first end of said second rod and said second end of said first rod each having a bore therethrough, a pin extending through said bores such that said first and second rods are pivotally coupled together, said second rod having an outer surface having threads thereon, said threads being generally adjacent to said second end of said second rod;

a first bracket, said first bracket being generally L-shaped having a foot portion and an arm portion, said foot portion having a bore therein, said second end of said second rod being inserted through said bore in said foot portion of said first bracket such that said arm portion of said first bracket is directed upwardly away from said second rod, said arm portion having a bore therein;

a first and second stop for holding said first bracket with respect to said second rod, said first stop being located on said second rod between said foot of said first bracket and said first end of said second rod, said second stop being located on said second rod between said foot and said second end of said second bracket, each of said stops being a nut; and a second bracket, said second bracket having a shape generally identical to said first bracket, said foot of said second bracket having two bores therein, said arm of said second bracket having a bore therein, said arm of said second bracket being rotatably coupled to said arm of said first bracket, said foot of said second bracket being removably coupled to a bottom surface of the toilet seat, said second bracket being generally adjacent to said distal end of said bowl.

6. A toilet seat lifting apparatus for use on a toilet having a bowl and a toilet seat hingedly coupled to the bowl, said apparatus comprising:

a lifting mechanism for lifting said toilet seat, said lifting mechanism comprising:

a base portion having a top surface, and a bottom surface for mounting on a floor adjacent to the toilet;

a platform;

a hinge pivotally connecting said platform to said base portion;

a first rod having a first end, a second end and an intermediate portion, said middle portion being coupled to said platform;

a second rod having a first end and a second end, said first end of said second rod being hingedly coupled to said second end of said first rod, said second end of said second rod being adapted for coupling to the toilet seat;

said hinge being generally U-shaped, said hinge having two legs and middle portion, said two legs defining a V-shaped space, a pair of plates for reinforcing said hinge, each of said plates being embedded in one of said legs, a first of said legs being fastened to said base portion; and a coupling means for coupling said platform to a second leg of said hinge.

7. The toilet seat lifting apparatus as in claim 6, further comprising:

a plurality of securing means for securing said base portion to a floor, said plurality of securing means comprising four securing fasteners, each of said securing fasteners extending through said base portion and into said floor.

8. The toilet seat lifting apparatus as in claim 6, wherein said platform is generally planar, said platform having a top surface and a bottom surface, said platform having a generally rectangular shape.

9. The toilet seat lifting apparatus as in claim 6, wherein said coupling means has a first end and a second end, said first end being threaded, said first end being inserted through said platform and through said second leg such that said bottom surface of said platform is abutted against said second leg of said hinge, said second end of said coupling mean forming an annular member.

10. The toilet seat lifting apparatus as in claim 6, wherein said first rod extends through said annular member, said first rod having a bend therein, said bend being generally adjacent to said first end, said bend being substantially equal to ninety degrees such that said first end extends away from said bowl, said second end of said first rod being generally between said distal end of said bowl and said base portion.

11. The toilet seat lifting apparatus as in claim 10, wherein said first end of said second rod and said second end of said first rod each have a bore therethrough, a pin extending through said bores such that said first and second rods are pivotally coupled together, said second rod having an outer surface having threads thereon, said threads being generally adjacent to said second end of said second rod.

12. The toilet seat lifting apparatus as in claim 11, further comprising:

a first bracket for coupling said second rod to said toilet seat, said first bracket being generally L-shaped having a foot portion and an arm portion, said foot portion having a bore therein, said second end of said second rod being inserted through said bore in said foot portion of said first bracket such that said arm portion of said first bracket is directed upwardly away from said second rod, said arm portion having a bore therein;

a first and second stop for holding said first bracket with respect to said second rod, said first stop being located on said second rod between said foot of said first bracket and said first end of said second rod, said second stop being located on said second rod between said foot and said second end of said second bracket; and a second bracket, said second bracket having a shape generally similar to said first bracket, said foot of said second bracket having two bores therein, said arm of said second bracket having a bore therein, said arm of said second bracket being rotatably coupled to said arm of said first bracket, said foot of said second bracket being removably couplable to a bottom surface of the toilet seat.

* * * * *